US007837413B1

(12) United States Patent
Kundel, Sr.

(10) Patent No.: US 7,837,413 B1
(45) Date of Patent: Nov. 23, 2010

(54) ADJUSTABLE TRENCH BOX AND SPREADER BAR

(76) Inventor: Robert Kundel, Sr., 2186 Howland Wilson Rd., Cortland, OH (US) 44410

( * ) Notice: Subject to any disclaimer, the term of this patent is extended or adjusted under 35 U.S.C. 154(b) by 360 days.

(21) Appl. No.: 12/009,962

(22) Filed: Jan. 23, 2008

(51) Int. Cl.
*E04G 25/04* (2006.01)

(52) U.S. Cl. ..... 405/283; 248/354.4; 248/354.5; 248/354.6; 248/644; 411/255; 411/433

(58) Field of Classification Search ..... 405/282, 405/283, 272; 248/351, 354.1, 354.3, 354.4, 248/354.5, 354.6, 200.1, 644; 411/246, 255, 411/433
See application file for complete search history.

(56) References Cited

U.S. PATENT DOCUMENTS

| | | | | |
|---|---|---|---|---|
| 891,897 | A * | 6/1908 | Astrom | 254/101 |
| 2,584,015 | A * | 1/1952 | Hawes | 248/354.4 |
| 2,956,409 | A | 10/1960 | Wicke | |
| 3,331,210 | A * | 7/1967 | Wenninger | 405/282 |
| 3,362,168 | A | 1/1968 | Dotlich | |
| 3,621,660 | A | 11/1971 | Krings | |
| 3,822,850 | A * | 7/1974 | Elias | 248/551 |
| 3,851,856 | A * | 12/1974 | Berg | 254/93 R |
| 4,056,938 | A | 11/1977 | Griswold | |
| 4,056,940 | A | 11/1977 | Fisher | |
| 4,453,863 | A | 6/1984 | Sutton et al. | |
| 5,073,066 | A | 12/1991 | Richland | |
| 5,096,334 | A | 3/1992 | Plank | |
| 5,137,488 | A * | 8/1992 | Yeh | 446/397 |
| 5,310,290 | A | 5/1994 | Spencer | |
| 5,503,504 | A | 4/1996 | Hess et al. | |
| 5,590,863 | A * | 1/1997 | Sasaki | 248/354.3 |
| 6,017,170 | A | 1/2000 | Michalo | |
| 6,039,522 | A * | 3/2000 | Cardona | 410/127 |
| 6,443,665 | B1 | 9/2002 | Kundel, Sr. | |
| 6,467,741 | B1 * | 10/2002 | Shih | 248/200.1 |
| 6,746,183 | B1 * | 6/2004 | Sullivan | 405/272 |
| 6,964,542 | B1 * | 11/2005 | Sullivan | 405/272 |
| 7,101,119 | B2 | 9/2006 | Cerda | |
| 7,258,511 | B1 | 8/2007 | Cerda | |
| 7,309,190 | B1 * | 12/2007 | Sullivan | 405/278 |
| 7,387,470 | B2 * | 6/2008 | McCracken | 405/272 |
| 7,584,932 | B2 * | 9/2009 | Shih | 248/354.3 |
| 2003/0031514 | A1 * | 2/2003 | Nicholson | 405/133 |
| 2003/0190197 | A1 * | 10/2003 | Lanka | 405/272 |
| 2005/0161571 | A1 * | 7/2005 | Wood | 248/354.3 |
| 2007/0269290 | A1 * | 11/2007 | Chang | 411/548 |

FOREIGN PATENT DOCUMENTS

WO WO 2005/106132 A1 11/2005

* cited by examiner

*Primary Examiner*—Tara Mayo-Pinnock
(74) *Attorney, Agent, or Firm*—Robert J. Herberger

(57) ABSTRACT

An adjustable spreader bar of a trench box has male and female telescoping pipes. The male telescoping pipe has a plurality of indexed openings, and the female telescoping pipe has an outer threaded portion with a groove to receive a locking pin. A sleeve is threadably attached to the outer threaded portion of the female telescoping pipe, and the sleeve has a sleeve opening and an inside channel for receiving the locking pin therethrough, so that fine adjustments, in the relationship between opposing panels of the trench box, can be made by rotating the sleeve about the threaded portion of the female pipe for extension or retraction of the male pipe, by forcing the locking pin along the groove.

13 Claims, 4 Drawing Sheets

(section 5A-5A)

(section 5C-5C)

ADJUSTABLE TRENCH BOX AND SPREADER BAR

FIELD OF THE INVENTION

The invention relates to a portable shoring device for securing sidewalls of a trench or excavation, also known in the industry as a trench box. More specifically, the instant invention relates to an adjustable spreader bar to manipulate the distance between opposing panels of the trench box.

BACKGROUND OF THE INVENTION

The construction industry often desires to employ excavations of various types, such as foundations, trenches, and the like. Where excavations are made in the earth, it is desirable to support the upright sidewalls of the excavation against collapse or to protect a sheltered work space in the event of collapse. Due to unstable soil conditions, improper sloping of an excavation and/or other unaccounted for occurrences, landslides and cave-ins ensue. These natural occurrences have been known to destroy equipment, postpone job completion and, most seriously, injure or kill the workers within the excavation. Consequently, trench excavation is recognized by the Occupational Safety and Health Administration ("OSHA") as being an extremely hazardous construction operation and it has promulgated regulations directed to the manner in which excavations are created and to the structures used to support the excavations against sidewall collapse.

Current practice in the industry is to place trench boxes inside an excavation site. The trench boxes generally are open at the bottom so that excavation can continue while the boxes are in place and open at the top for easy access by men and machinery and easy removal of excavated materials. The primary structure of a trench box is comprised of opposing side panels that perform a shoring or shielding function by holding the sidewalls of the excavation in place, preventing the sidewalls from collapsing into the trench or hole in the ground created by excavating. Additionally, trench boxes usually have a plurality of bars or beams that transverse the lateral width of the trench box, attaching to opposing trench box panels and reinforcing or supporting the opposing panels, thus providing further protection from sidewall collapse. These support bars are also known as spreader bars as they assist in keeping the panels sufficiently spread apart from each other.

It is often desirable that the width between the opposing panels be changed and/or the angle of opposing planar panel surfaces of the trench box be increased or decreased (from parallel), which can be unsafe and time-consuming, especially when the trench box already is in place within the excavation. In particular, fine adjustments often are desired. More specifically, there is a need to be able to adjust the space and/or angle between the opposing panels of the trench box, particularly when the trench box is being driven into or pulled from the excavation.

Spreader bars currently in use are adjustable in length only in limited ways, such as by use of spreader bars or components thereof that have different fixed lengths, by manipulating angled components of predetermined lengths so as to create an outward extension of the support device, or by use of a hydraulic motor to extend the spreader bar when needed.

For example, U.S. Pat. No. 2,956,409 to Wicke (hereinafter the "'409 patent") describes an adjustable bracing apparatus for shoring walls where the width of the device is adjusted either by having different, wider lengths of rigid brace or support members between the vertical side panels, or by extending connecting rods outwardly causing internal shafts to slide to accommodate a corresponding extension of said shafts.

Also, U.S. Pat. No. 3,362,168 to Dotlich (hereinafter the "'168 patent") shows an apparatus for supporting the vertical walls of a trench that includes a hydraulic motor mechanism that maintains the side panels of the apparatus in shoring engagement with the vertical walls being adaptable to trench excavations of different lengths through use of pipe extensions of different lengths.

Notably, the '409 and '168 patents are limited in that neither can be used to push apart and pull together the opposing panels while in use as easily and precisely as the instant invention.

SUMMARY OF THE INVENTION

The object of the present invention is to provide adjustable internal support bars or spreader bars to hold apart opposing panels of a trench box used in excavation to prevent the sidewalls of the excavation from collapsing inwardly. More specifically, this invention satisfies the need for a shielding and shoring device that is safe, durable, and easy to use, assemble, move, and disassemble, and that can be adjusted to manipulate the distance and/or the planar angle between opposing panels of the trench box, even when the trench box is in place inside the excavation.

There are several advantages of the instant invention over the prior devices. For example, because of the use of a screw, the spreader bar can easily be retracted thus reducing the width of the space between panels of the trench box, and/or extended, increasing the width, as determined by the operator and as warranted under the circumstances. The present invention also facilitates fine adjustments by allowing the operator to extend or retract the spreader as little or, in conjunction with an incrementally adjustable spreader, by as much as necessary.

To accomplish these objectives, the present invention is directed to a new, infinitely adjustable spreader bar having male and female telescoping pipes, both with openings to receive a locking pin and threaded portion that allow the male telescoping pipe to extend or retract by mechanical engagement of a screw apparatus.

BRIEF DESCRIPTION OF THE DRAWINGS

Further features, objectives and advantages of the present invention will become clearer when referring to the following detailed description of the preferred embodiments made with reference to the accompanying drawings in which.

DETAILED DESCRIPTION OF PREFERRED EMBODIMENTS

The present invention is directed to a fine, infinitely adjustable, spreader bar 20 used in a trench box 10 for securing sidewalls of an excavation, the spreader bar allowing the opposing panels 12, 13 of the trench box 10 to be manipulated both inwardly and outwardly.

Figure 1:
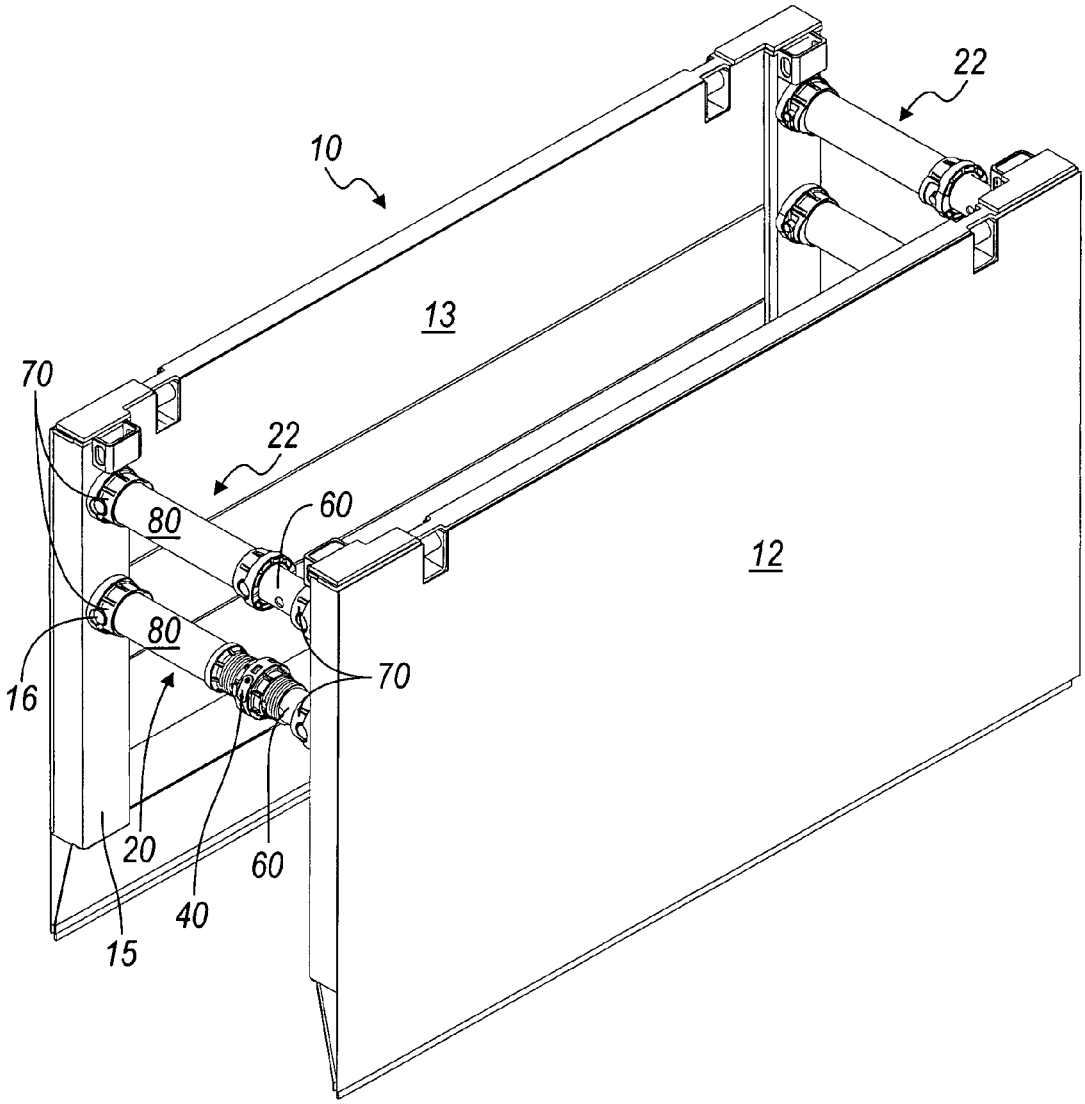
FIG. 1 is a perspective view of a trench box or shoring device which has both an incrementally finite adjustable spreader bar found in the prior art and an infinitely adjustable spreader bar of the instant invention for finer adjustment.

Viewing FIG. 1, adjustment bars of two types are shown to manipulate the space between the vertical side panels 12, 13 of the trench box 10. The top spreader bar 22 is known in the prior art and is used for relatively larger, finite, incremental adjustment during assembling of the trench box 10. This finite, incrementally adjustable spreader bar 22 is telescopically connected at each end to a male spreader bar adaptor socket 14 affixed to the panels 12, 13. Specifically, a socket bolt or locking pin 16 is inserted to attach each female socket receiving end 70 of the first and second pipes, 60 and 80 respectively, with its corresponding socket 14. In assembly, the incrementally adjustable spreader bar 22 is subject to length adjustments in larger increments by use of the male first pipe 60 telescopically fitting within the female second pipe 80, and then fixed by a bolt or locking pin through indexed openings 62 spaced apart at selective distances. In most cases, the incrementally adjustable spreader bar 22 is selected to the appropriate length during assembly, i.e. before the trench box 10 is placed inside the excavation.

Notably, the present invention includes a fine adjustment spreader bar 20 which also is connected between panels 12, 13 by adaptor sockets 14, the same way the finite, incrementally adjustable spreader bar 22 is attached to the opposing panels 12, 13, described above.

It is important to note that the infinitely adjustable spreader bar 20 of the instant preferred design is also subject to adjustment in larger, finite increments in the same manner as the incrementally adjustable spreader bar 22. Additionally and more importantly, the infinitely adjustable spreader bar 20 can also be adjusted in significantly small amounts as described below.

Specifically, with reference to FIG. 1, the preferred embodiment has a first pipe 60 that has first and second opposing ends, 63 and 64, respectively. The first end 63 is removably attachable to the male spreader bar adaptor socket 14, which is, in turn, attached to the first opposing side panel 12 of the trench box 10, as described above. The second end 64 is telescopically fitted along a longitudinal axis in the second end 84 of the second pipe 80. Again, like the incrementally adjustable spreader bar 22, the first pipe 60 includes a plurality of indexed openings 62 spaced for selective engagement, with each opening 62 passing through the first pipe 60.

Figure 2:
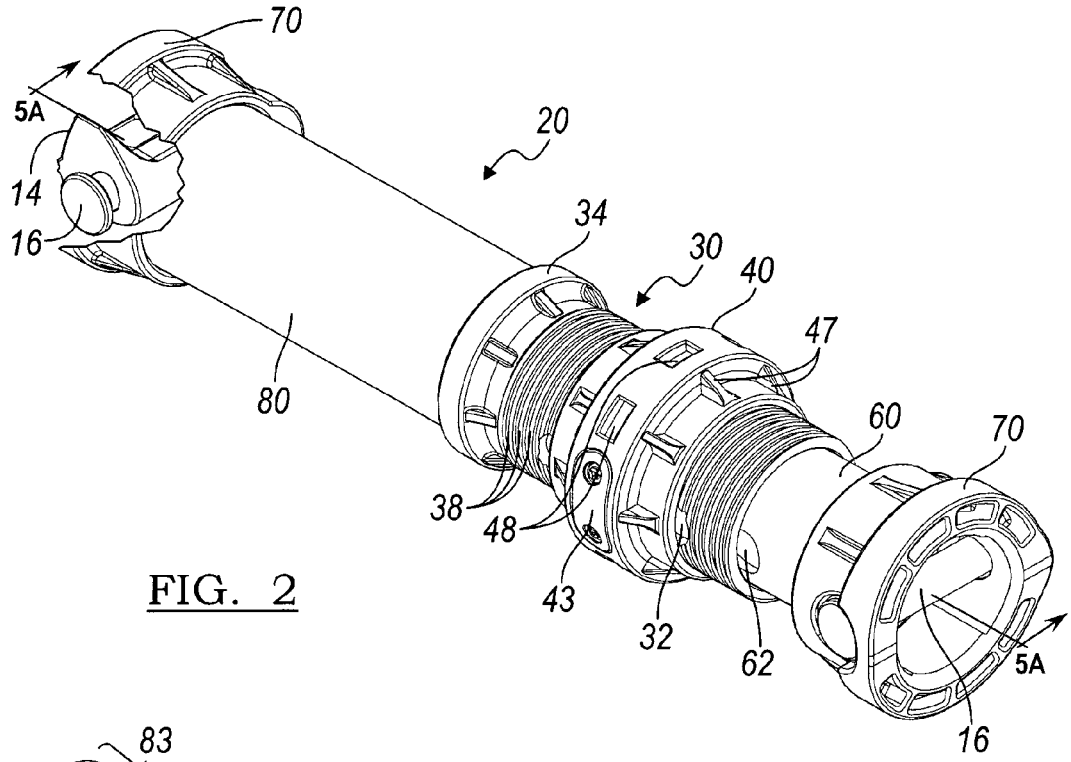
FIG. 2 is the perspective view of the preferred embodiment of the unique infinitely adjustable spreader bar of the instant invention.
Figure 3:
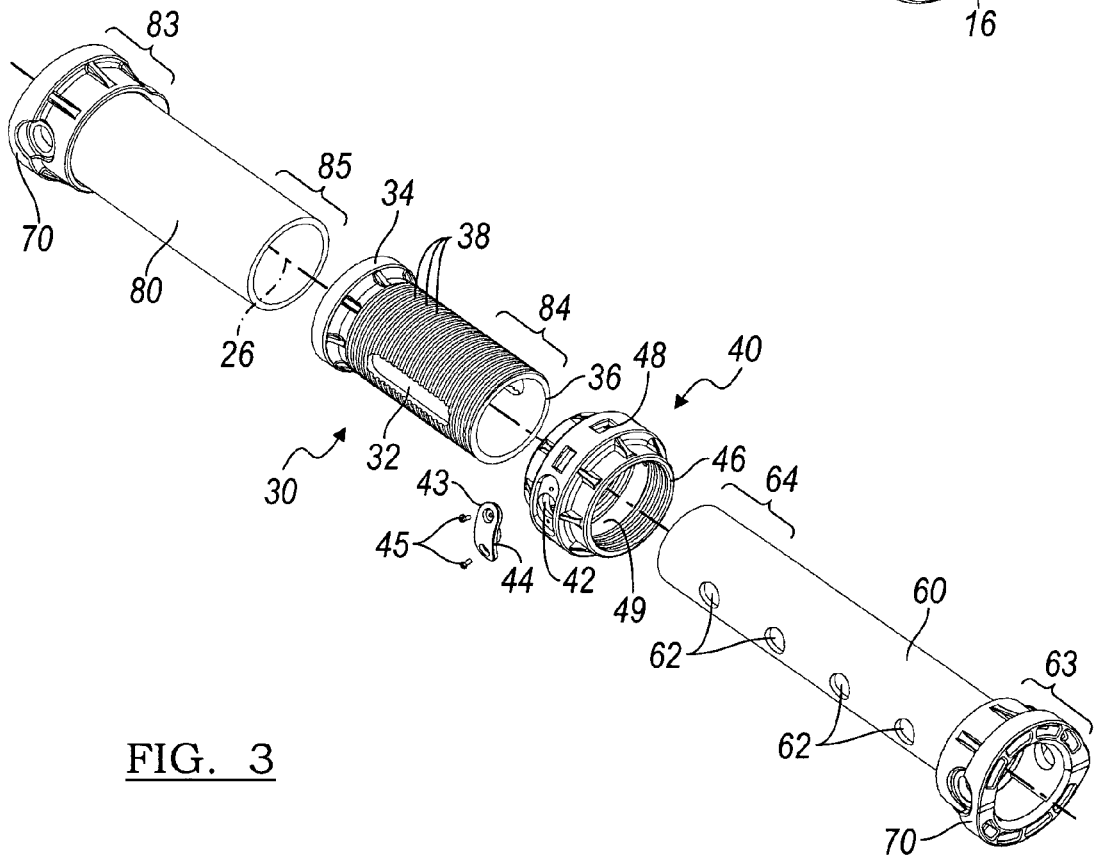
FIG. 3 is an exploded view of the infinitely adjustable spreader bar shown in FIG. 2.
Figure 4:
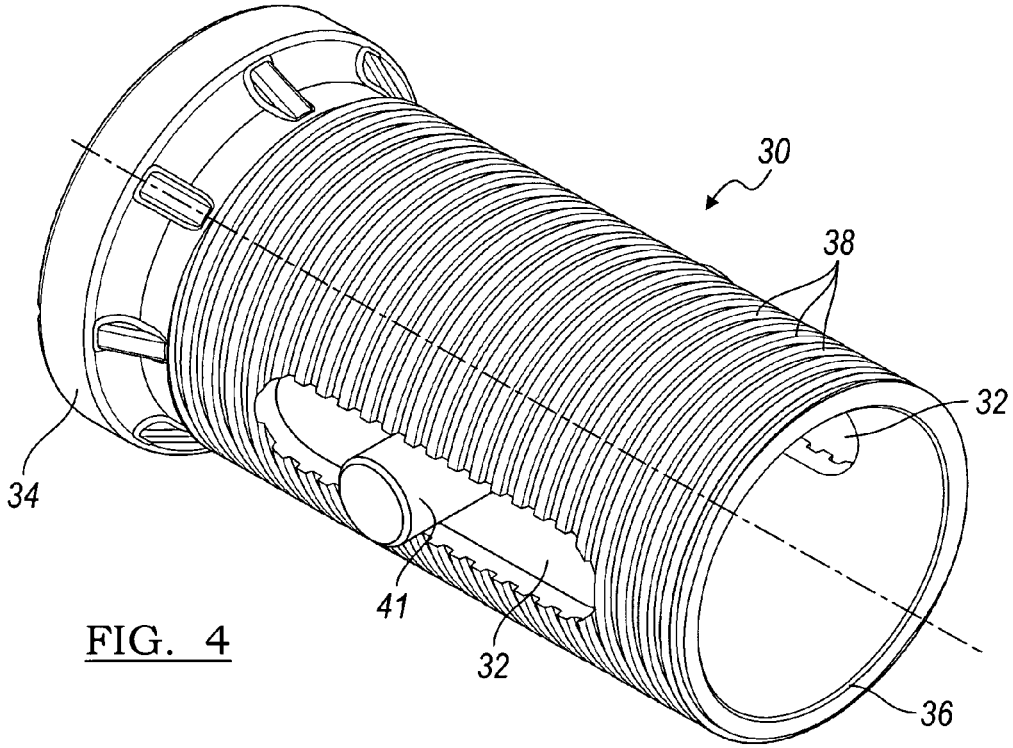
FIG. 4 is a perspective view of the adjustment screw portion with an outer thread shown herein as an adaptor to be permanently attached to the female telescoping pipe of the infinitely adjustable spreader bar of the instant invention.

The second pipe 80 of the infinitely adjustable spreader bar 20 includes first and second opposing ends, 83 and 84, respectively, with a first end 83 being removably attached to adaptor socket 14, which is, in turn, attached to the second opposing panel 13 of the trench box 10. The second end 84 is telescopically fitted with the second end 64 of the first pipe 60. The second pipe 80 also includes a cylindrical adjustment screw portion 30, as shown in FIGS. 2, 3 and, more specifically, FIG. 4, which can be manufactured as an integral part of the second pipe 80, or separately fabricated as an adaptor and permanently attached to the second pipe 80, at the intermediate end 85, for example, by welding.

The adjustment screw portion 30 of the second pipe 80 has an outer thread 38 and an elongated, grooved opening or slot 32 therethrough with a length substantially aligned with the longitudinal axis 26 of the telescopically fitted first and second pipes, 60 and 80. The helical direction of the outer thread 38 is in the direction of said longitudinal axis 26. The adjustment screw portion 30, as an adaptor, has a female fitted end 34 that is fixedly attached to an intermediate end 85 of the second pipe 80, forming a female receiving end 36 at the second end 84 of the second pipe 80.

Figure 5A:
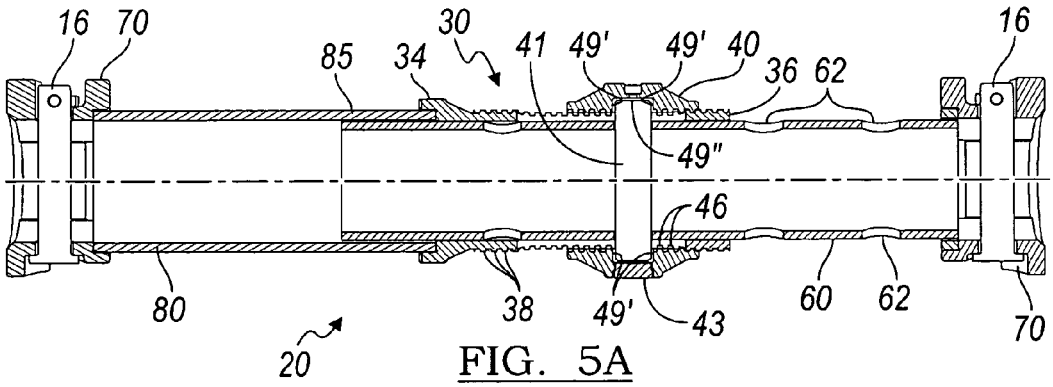
FIG. 5A is a cross-sectional view of the infinitely adjustable spreader bar taken at line 5A-5A of FIG. 2.

As best seen in FIG. 5A, the first pipe 60 telescopes into the second pipe 80, and over both is threadably fitted a sleeve 40, which includes an inner sleeve thread 46 to engage the adjustment screw outer thread 38. A sleeve pin opening 42, shown in FIG. 3, passes through the sleeve 40 to an inner sleeve pin engagement channel 49. A locking pin 41, which is longer in length than an outside diameter of the adjustment screw portion 30 and shorter in length than an inside diameter of the inner sleeve pin engagement channel 49, freely fits within the channel depth 49" and loosely engages the channel wall 49'. Notably, unless the sleeve 40 is die cast, the sleeve thread 46 preferably extends only on one side of the channel 49, because of alignment registration difficulties with mating to the adjustment screw outer thread 38, caused by the intervening channel 49.

When assembled, the locking pin 41 passes through the sleeve opening 42, the elongated, grooved opening 32 of the second pipe 60, and a selected, indexed opening 62 of the first pipe 80, so that when the sleeve 40 is turned along outer thread 38 of the adjustment screw portion 30 of the second pipe 80, the first pipe 60 is forced by the engagement of the locking pin 41 along the elongated grooved opening 32 to change the extended length of the telescoping pipes 60, 80, and to correspondently adjust the spaced relationship between the opposing panels 12, 13 of the trench box 10 in any length within the length of the grooved opening.

Figure 5B:
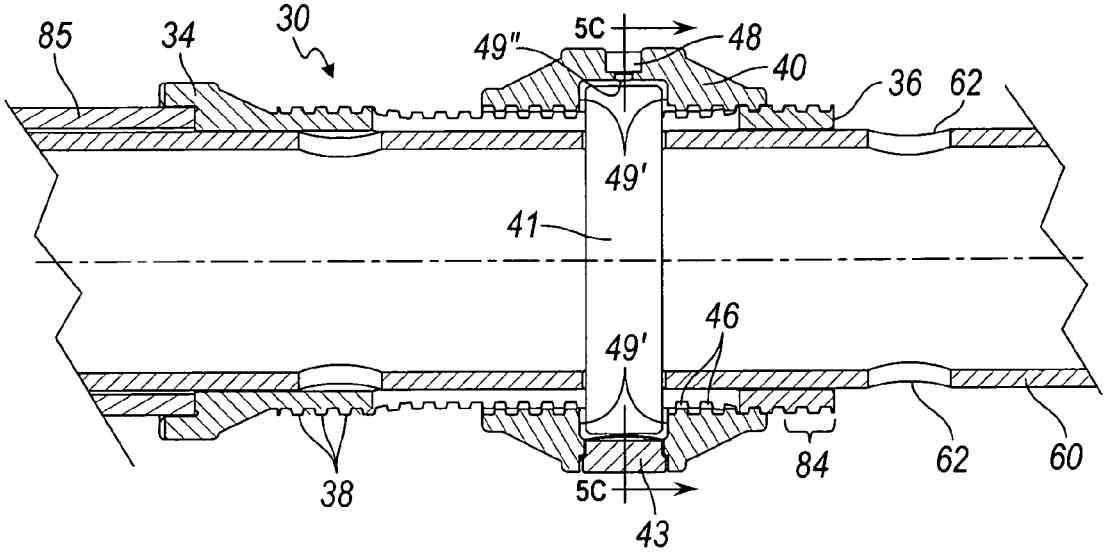
FIG. 5B is an enlarged sectional view of the adjustment screw portion shown in FIG. 5A.
Figure 5C:
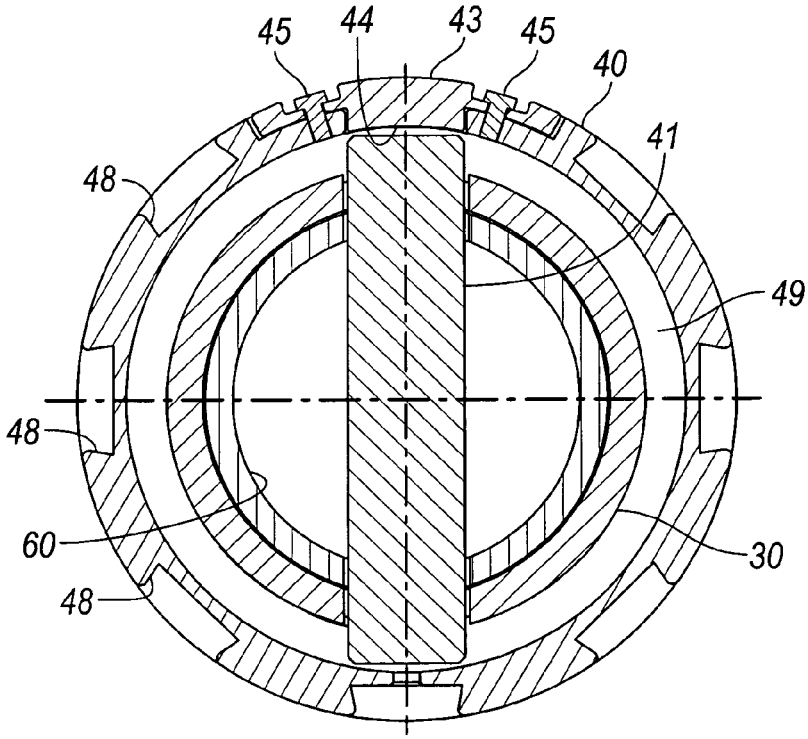
FIG. 5C is a cross-sectional view of the adjustment screw portion taken at line 5C-5C of FIG. 5B, showing engagement between the locking pin and inner sleeve pin engagement channel to adjust the telescopic length of the first and seconds.

Referring back to FIG. 3, a sleeve opening cover 43 keeps the locking pin 41 confined in place fits over the sleeve pin opening 42, and securely attaches to the sleeve 40 by attachment screws 45. The cover 43 includes an inner arc 44 substantially matching a cylindrical curve portion of the sleeve channel 40 to permit unobstructed and free movement of the ends of the pin 41 therein, best seen in FIGS. 5B and 5C. In the preferred embodiment, sleeve 40 also includes sleeve teeth or notches 48 for engagement with a tool (not shown) used to torque the sleeve 40 in either rotational direction along the thread 38 of the screw portion 30 and about the longitudinal axis of the fitted pipes 60, 80.

In use, side panels 12, 13 of the trench box 10 are spaced and arranged substantially parallel, and securely fitted at opposite longitudinal ends with both the incrementally finite adjustable spreader bar 22 and the infinitely adjustable spreader bar 20 in a stacked relationship. It is not important which is stacked near the top of the vertical panels or near the bottom. Each spreader bar 20, 22 is pinned to a desired length by selecting the appropriate opening 62, to preferably align panels 12, 13 substantially parallel to each other.

The trench box 10 is then placed in the excavation, where it often is forced below the floor of the excavation by hammering the top of the panels 12, 13 with the bucket of a backhoe. To avoid the ground forcing the panels apart during the hammering step, it is preferred that the bottom of the trench box panels be toed inward. Using the instant invention, the finely adjustable spreader bar 20 can easily and quickly be telescopically adjusted in length by manually turning sleeve 40 in the appropriate rotational direction about the longitudinal axis of the telescopically fitted pipe 60, 80. As previously described, the properly positioned locking pin 41 is forced by a channel wall 49' of the sleeve engagement channel 49, wherein the locking pin is freely fitted for rotational movement therein, to push or pull the first pipe 60 along the elongated groove opening 32 of the second pipe 80, and thereby change the length of the telescoping pipes, and as a result, the angle of the planar surfaces of the panels 12, 13.

When removing the trench box 10 from the excavation, it is often preferred that the bottom portions of the opposing panels 12, 13 of the trench box 10 are toed outward in like, but opposite fashion, so that the trench box 10 releases its grip on the excavation floor to more easily lift the trench box 10 therefrom. In this case, the sleeve 40 is turned in the opposite rotational direction to change the length of the telescoping pipes 60, 80 as needed.

Although the present invention has been described in connection with the preferred embodiment illustrated in the accompanying figures, other variations and modifications may be apparent to those skilled in the art which come within the scope of the present invention as defined by the claims which follow.

What is claimed is:

1. An adjustable spreader bar for securing oppositely spaced first and second panels of a trench box, the spreader bar comprising:

a first pipe having first and second opposing ends, an outside diameter and a plurality of indexed openings spaced for selective engagement, each indexed opening passing through the first pipe, and the first end of the first pipe being removably attachable to the first panel;

a second pipe having first and second opposing ends and an inside diameter greater than the outside diameter of the first pipe for a telescopic fit of the second ends of the first and second pipes along a longitudinal axis, the first end of the second pipe being removably attachable to the second panel and the second pipe having an adjustment screw portion with an outer thread and an elongated, grooved opening therethrough having a length substantially aligned with said longitudinal axis of the telescopically fitted pipes;

a sleeve threadably attached to the thread of the adjustment screw portion of the second pipe, the sleeve having an inner surface with an inner sleeve channel formed with opposing channel walls and an opening passing through the sleeve at the channel, the sleeve opening has a cover with an inside arc that substantially matches a contour of the sleeve channel in said inner surface; and a locking pin to pass through the sleeve opening, the grooved opening of the second pipe and a selected indexed opening of the first pipe, wherein the locking pin has a pin length and fitted ends to seat in said sleeve channel within the inner surface, so that when the sleeve is turned along the thread of the adjustment screw portion of the second pipe, the first pipe is forced by the locking pin along the grooved opening by one of the channel walls to change the length of the telescoping pipes to extend and the other channel wall to shorten, in order to adjust the spaced relationship between the trench panels.

2. The adjustable spreader bar of claim 1, wherein the sleeve has an outer surface with teeth for engagement for turning the sleeve along the thread of the adjustment screw portion of the second pipe.

3. The adjustable spreader bar of claim 1, wherein the plurality of index openings passing through the first pipe are aligned and equally spaced.

4. The adjustable spreader bar of claim 3, wherein the length of the grooved opening in the second pipe is no greater than a length between the equally spaced indexed openings.

5. The adjustable spreader bar of claim 3, wherein the first and second pipes are removably attachable to their respective first and second trench box panels by pinning each of the first ends to a socket telescopically fitted therewith.

6. The adjustable spreader bar of claim 4, wherein the adjustment screw portion is an adaptor securely attached to the second pipe.

7. A trench box for securing the sidewalls of an excavation, the trench box comprising:

first and second panels being spaced apart; and at least two spreader bars traversing said space, each spreader bar having first and second pipes, a sleeve and a locking pin;

said first pipe having first and second opposing ends, an outside diameter and a plurality of indexed openings spaced for selective engagement, each indexed opening passing through the first pipe, and the first end of the first pipe being removably attachable to the first panel;

said second pipe having first and second opposing ends and an inside diameter greater than the outside diameter of the first pipe for a telescopic fit along a longitudinal axis of the second ends of the first and second pipes, the first end of the second pipe being removably attachable to the second panel, and the second pipe having a threaded portion with an outer thread and an elongated, grooved opening therethrough having a length substantially aligned with said longitudinal axis of the telescopically fitted pipes;

said sleeve threadably attached to the threaded portion of the adjustment screw of the second pipe, the sleeve having an inner surface with an inner sleeve channel along the perimeter of the inner surface and an opening passing through the sleeve at the channel, the sleeve channel having a depth and channel walls, and the sleeve opening has a cover with an inside arc that substantially matches a contour of the sleeve channel; and said locking pin being longer in length than an outside diameter of the screw portion of the second pipe and shorter in length than an inside diameter of the inner sleeve channel, so that the pin freely fits within the depth of the channel and engages one of the channel walls when the sleeve is turned along the threaded portion of the second pipe, thereby forcing the pin along the elongated grooved opening to change the length of the telescoping pipes, which adjust the spaced relationship between the panels of the trench box by extension and shortening of the spreader bar.

8. The adjustable spreader bar of claim 7, wherein the sleeve has an outer surface with teeth for engagement for turning the sleeve along the thread of the threaded portion of the second pipe.

9. The adjustable spreader bar of claim 7, wherein the plurality of index openings passing through the first pipe are aligned and equally spaced.

10. The adjustable spreader bar of claim 9, wherein the length of the grooved opening in the second pipe is no greater than a length between the equally spaced indexed openings.

11. The adjustable spreader bar of claim 10, wherein the adjustment screw portion is an adaptor attached to the second pipe.

12. The adjustable spreader bar of claim 9, wherein the first and second pipes are removably attachable to their respective first and second trench box panels by pinning each of the first ends to a socket telescopically fitted therewith.

13. A trench box for securing the sidewalls of an excavation, the trench box comprising:

first and second panels being spaced apart; and a spreader bar traversing said space, the spreader bar having first and second pipes, a sleeve and a locking pin;

said first pipe having first and second opposing ends, an outside diameter and a plurality of indexed openings spaced for selective engagement, each indexed opening passes through the first pipe and is aligned and equally spaced from an adjacent indexed opening, and the first end of the first pipe being removably attachable to the first panel;

said second pipe having first and second opposing ends and an inside diameter greater than the outside diameter of the first pipe for a telescopic fit along a longitudinal axis of the second ends of the first and second pipes, the first end of the second pipe being removably attachable to the second panel, and the second pipe having a threaded portion with an outer thread and an elongated, grooved opening therethrough having a length substantially aligned with said longitudinal axis of the telescopically fitted pipes, the length of the grooved opening being no greater than a length between the equally spaced indexed openings;

said sleeve threadably attached to the threaded portion of the adjustment screw of the second pipe, the sleeve having an inside surface, an inner sleeve channel formed in said inside surface and an opening passing through the sleeve at the channel, the sleeve channel having a depth and channel walls, and the sleeve opening has a cover with an inside arc that substantially matches a contour of the sleeve channel; and said locking pin being longer in length than an outside diameter of the screw portion of the second pipe and shorter in length than an inside diameter of the inner sleeve channel, the locking pin having ends that freely fit within the depth of the channel, so that each locking pin end engages the channel walls when the sleeve is turned along the threaded portion of the second pipe, thereby forcing the length of the telescoping pipes to change by extension and shortening to adjust the spaced relationship between the panels of the trench box.

* * * * *